US010480300B2

(12) United States Patent
Guidry

(10) Patent No.: US 10,480,300 B2
(45) Date of Patent: Nov. 19, 2019

(54) FRACTURING SYSTEM WITH FLEXIBLE CONDUIT

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 234 days.

(21) Appl. No.: 15/492,251

(22) Filed: Apr. 20, 2017

(65) Prior Publication Data

US 2017/0314379 A1 Nov. 2, 2017

Related U.S. Application Data

(60) Provisional application No. 62/330,188, filed on May 1, 2016.

(51) Int. Cl.
*E21B 43/26* (2006.01)

(52) U.S. Cl.
CPC ..... *E21B 43/26* (2013.01)

(58) Field of Classification Search
CPC . F16L 33/01; F16L 11/15; F16L 27/11; E21B 43/26
See application file for complete search history.

(56) References Cited

U.S. PATENT DOCUMENTS 1,051,046 A * 1/1913 Witzenmann ..... F16L 33/01 138/131
1,329,760 A * 2/1920 Fulton ..... F16L 33/01 279/76
1,615,536 A 1/1927 Del Mar
2,556,544 A * 6/1951 Fredrick ..... F16L 33/2071 285/222.5
2,934,095 A * 4/1960 Lockhart ..... F16L 51/025 138/121
3,118,691 A * 1/1964 Press ..... F16L 33/01 285/222.1
3,233,668 A 2/1966 Hamilton et al.
3,306,637 A * 2/1967 Press ..... F16L 33/01 285/222.1
3,393,267 A * 7/1968 Busse ..... F16L 25/01 174/78
3,581,775 A 6/1971 Dahl
(Continued)

FOREIGN PATENT DOCUMENTS

CA 2178856 12/1997
EP 1101997 A1 5/2001

OTHER PUBLICATIONS

Guidry, U.S. Appl. No. 15/375,558, filed Dec. 12, 2016.
Guidry, U.S. Appl. No. 15/422,284, filed Feb. 1, 2017.

*Primary Examiner* — Kipp C Wallace
(74) *Attorney, Agent, or Firm* — Eubanks PLLC

(57) ABSTRACT

A fracturing fluid delivery system is provided. In one embodiment, the system includes a fracturing manifold and a fracturing tree. A fluid conduit is coupled between the fracturing manifold and the fracturing tree to enable receipt of fracturing fluid by the fracturing tree from the fracturing manifold through the fluid conduit. The fluid conduit includes rigid and flexible pipe segments coupled together so as to collectively provide a fluid connection from the fracturing manifold to the fracturing tree. Additional systems, devices, and methods are also disclosed.

13 Claims, 5 Drawing Sheets

(56) References Cited

U.S. PATENT DOCUMENTS 3,934,902 A * 1/1976 McNamee ..... F16L 25/0036 285/133.21
4,355,961 A 10/1982 Riggs
4,366,864 A 1/1983 Gibson et al.
4,437,691 A * 3/1984 Laney ..... F16L 25/0036 285/331
4,570,673 A 2/1986 Kendrick et al.
4,603,887 A 8/1986 Mayfield et al.
4,767,136 A 8/1988 Lehmann
5,927,344 A 7/1999 Nobileau
6,004,639 A 12/1999 Quigley et al.
6,102,445 A * 8/2000 Thomas ..... F16L 25/0036 285/139.1
6,234,030 B1 5/2001 Butler
6,364,024 B1 4/2002 Dallas
8,839,867 B2 9/2014 Conrad
8,905,056 B2 12/2014 Kendrick
8,978,763 B2 3/2015 Guidry
9,068,450 B2 6/2015 Guidry
9,127,545 B2 9/2015 Kajaria et al.
9,222,345 B2 12/2015 Conrad
9,255,469 B2 2/2016 Conrad
9,518,430 B2 12/2016 Guidry
2003/0205378 A1 11/2003 Wellington et al.
2003/0205385 A1 11/2003 Duhn et al.
2004/0251020 A1 12/2004 Smith
2008/0277120 A1 11/2008 Hickie
2009/0261575 A1 10/2009 Bull et al.
2010/0051261 A1 3/2010 Koleilat et al.
2010/0300672 A1 12/2010 Childress et al.
2011/0030963 A1 2/2011 Demong et al.
2011/0108275 A1 5/2011 Borak et al.
2011/0114320 A1 5/2011 Sponchia et al.
2011/0132596 A1 6/2011 Yeh et al.
2011/0259584 A1 10/2011 Broussard, II
2012/0181015 A1 7/2012 Kajaria et al.
2012/0181016 A1 7/2012 Kajaria et al.
2012/0181030 A1 7/2012 Kajaria et al.
2013/0076026 A1 3/2013 Guidry
2013/0284455 A1* 10/2013 Kajaria ..... E21B 43/26 166/379
2014/0007970 A1 1/2014 Dodds
2014/0246211 A1 9/2014 Guidry et al.
2015/0083426 A1* 3/2015 Lesko ..... B60P 1/00 166/308.1
2016/0363242 A1* 12/2016 De Nora ..... F16L 11/118

* cited by examiner

FRACTURING SYSTEM WITH FLEXIBLE CONDUIT

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. A fracturing manifold may provide fracturing fluid to one or more fracturing trees via fracturing lines (e.g., pipes). But the fracturing manifolds and associated fracturing tress are typically large and heavy, and may be mounted to other equipment at a fixed location, making adjustments between the fracturing manifold and a fracturing tree difficult.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to fracturing fluid delivery systems having adjustable fluid connectors that bend to facilitate coupling of fracturing manifolds with fracturing trees. In one embodiment, a fracturing manifold is connected to a fracturing tree with a single, flexible fracturing fluid connector. This fluid connector is provided as a conduit having a combination of rigid pipe segments and flexible pipe segments. The flexible pipe segments can be bent during installation to adjust the profile of the conduit and facilitate connection of the conduit between the fracturing manifold and the fracturing tree. In some instances, a flexible pipe segment of the conduit includes a removable liner to reduce erosive effects from fracturing fluid on an outer pipe body of the flexible pipe segment.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
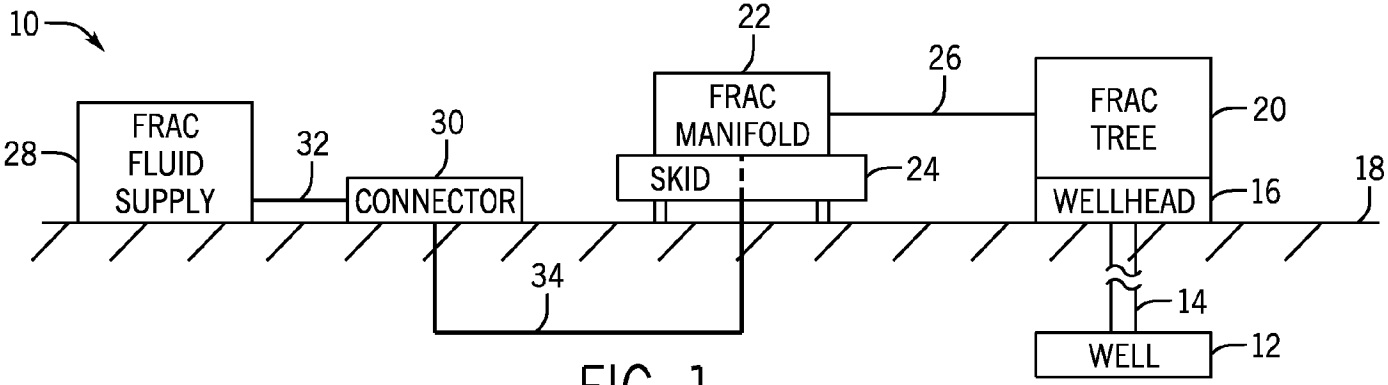
FIG. 1 generally depicts an adjustable fracturing system in accordance with an embodiment of the present disclosure.
Figure 2:
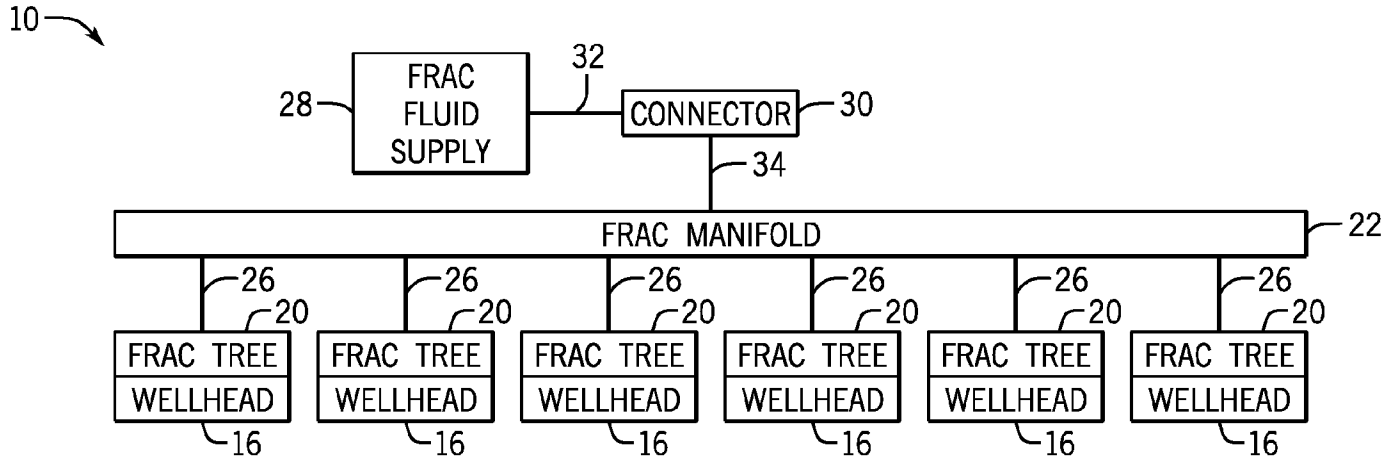
FIG. 2 is a diagram of the adjustable fracturing system of FIG. 1 with a fracturing manifold coupled to multiple fracturing trees in accordance with one embodiment.

Turning now to the present figures, an example of a fracturing system 10 is provided in FIGS. 1 and 2 in accordance with one embodiment. The fracturing system 10 facilitates extraction of natural resources, such as oil or natural gas, from a well 12 via a wellbore 14 and a wellhead 16. Particularly, by injecting a fracturing fluid into the well 12, the fracturing system 10 increases the number or size of fractures in a rock formation or strata to enhance recovery of natural resources present in the formation. In the presently illustrated embodiment, the well 12 is a surface well accessed by equipment of wellhead 16 installed at surface level (i.e., on ground 18). But it will be appreciated that natural resources may be extracted from other wells, such as platform or subsea wells.

The fracturing system 10 includes various components to control flow of a fracturing fluid into the well 12. For instance, the depicted fracturing system 10 includes a fracturing tree 20 and a fracturing manifold 22. The fracturing tree 20 includes at least one valve that controls flow of the fracturing fluid into the wellhead 16 and, subsequently, into the well 12. Similarly, the fracturing manifold 22 includes at least one valve that controls flow of the fracturing fluid to the fracturing tree 20 by a conduit or fluid connection 26, such as one or more pipes.

The fracturing manifold 22 is mounted on at least one skid 24 (e.g., a platform mounted on rails) to facilitate movement of the fracturing manifold 22 with respect to the ground 18. As depicted in FIG. 2, the fracturing manifold 22 is connected to provide fracturing fluid to multiple fracturing trees 20 and wellheads 16. But it is noted that the fracturing manifold 22 may instead be coupled to a single fracturing tree 20 in full accordance with the present techniques. In one embodiment in which the fracturing manifold 22 is coupled to multiple fracturing trees 20, various valves of the fracturing manifold 22 may be mounted on separate skids 24 to enable variation in the spacing between the valves.

Fracturing fluid from a supply 28 is provided to the fracturing manifold 22. In FIG. 1, a connector 30 receives fracturing fluid from the supply 28 through a conduit or fluid connection 32, such as pipes or hoses, and then transmits the fluid to the fracturing manifold 22 by way of a subterranean conduit or fluid connection 34. The fracturing fluid could be routed from the supply 28 to the fracturing manifold 22 entirely above ground without use of a subterranean conduit 34 in other instances. In one embodiment, the fracturing fluid supply 28 is provided by one or more trucks that deliver the fracturing fluid, connect to the connector 30, and pump the fluid into the fracturing manifold 22 via the connector 30 and connections 32 and 34. In another embodiment, the fracturing fluid supply 28 is in the form of a reservoir from which fluid may be pumped into the fracturing manifold 22. But any other suitable sources of fracturing fluid and manners for transmitting such fluid to the fracturing manifold may instead be used.

Figure 3:
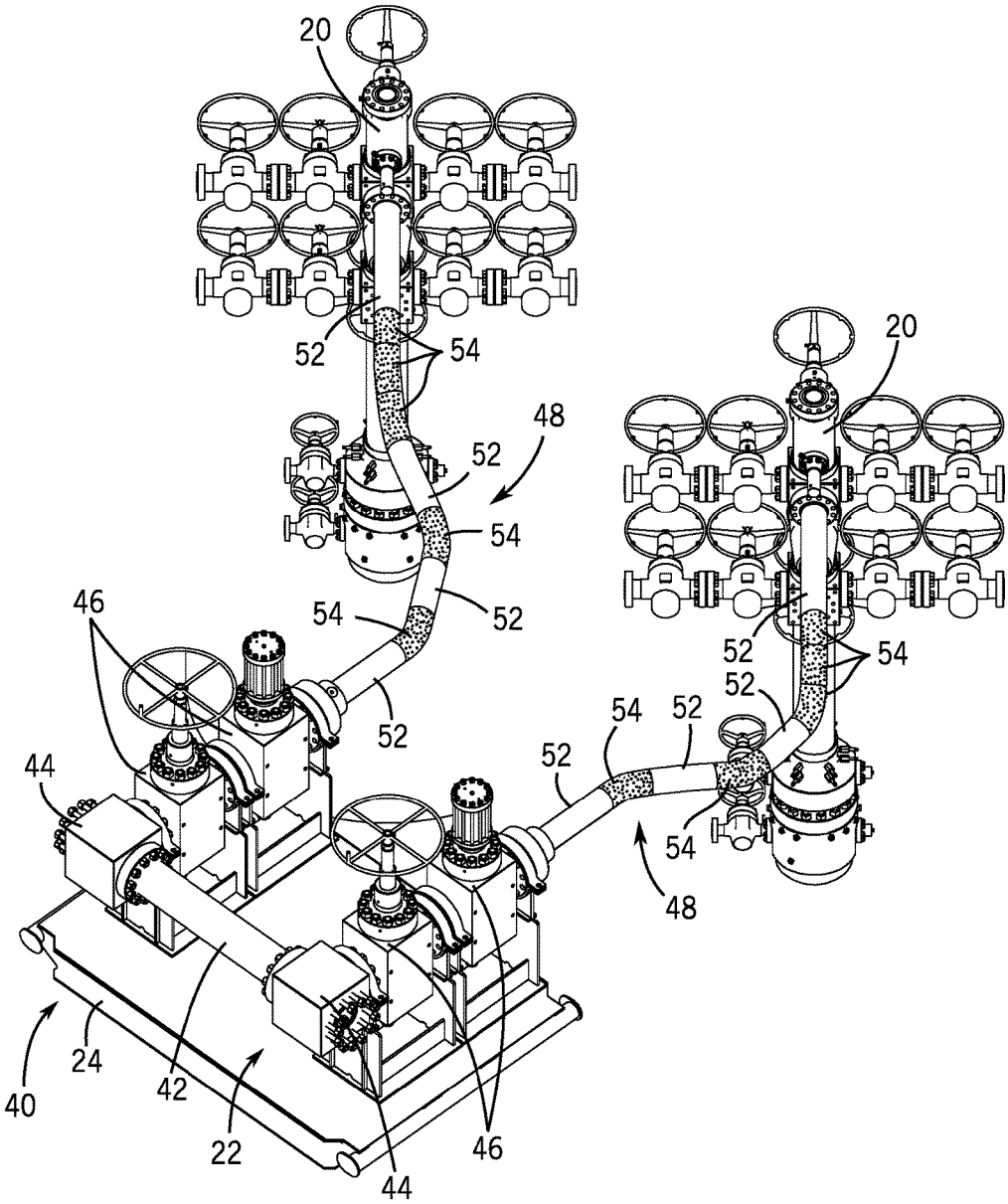
FIG. 3 is a perspective view of certain components of an adjustable fracturing system, including a portion of the fracturing manifold mounted on a skid and joined to fracturing trees with flexible fluid conduits, in accordance with an embodiment of the present disclosure.

In at least some embodiments, fluid conduits with flexible portions are coupled between the fracturing manifold 22 and fracturing trees 20 to facilitate assembly of a fracturing fluid delivery system. One such example is generally depicted in FIG. 3 as having a skid-mounted assembly 40 of the fracturing manifold 22 coupled to a pair of fracturing trees 20 by fluid conduits 48. The assembly 40 includes a pipe 42 spanning connection blocks 44. The pipe 42 and the connection blocks 44 are part of a trunk line of the manifold 22 for routing fracturing fluid to be delivered to multiple fracturing trees, and it will be appreciated that other pipes or conduits can be coupled to the connection blocks 44 to join other portions of the trunk line (e.g., to other skid-mounted assemblies 40, which can be coupled to additional fracturing trees 20).

Valves 46 enable individual control of the flow of fracturing fluid from the trunk line to each fracturing tree 20 through the fluid conduits 48. The valves 46 are depicted here as mounted on the skid 24 as part of the assembly 40 of the fracturing manifold 22. In other instances, valves 46 could be positioned elsewhere (e.g., at the other end of the fluid conduits 48) or omitted (in which case valves of the fracturing trees could be used to control flow of fracturing fluid from the manifold into the wells).

Figure 4:
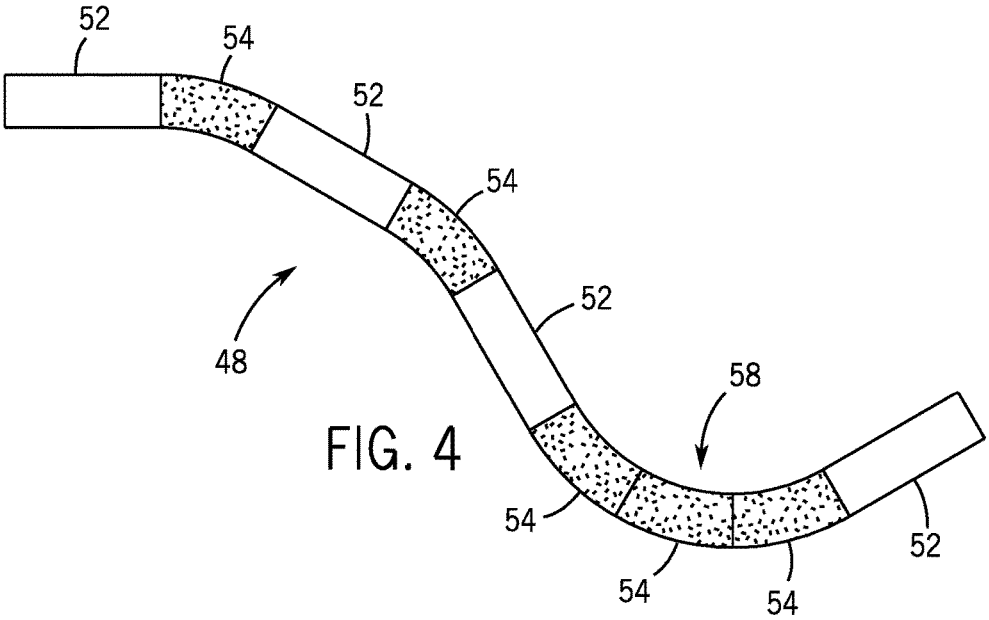
FIG. 4 depicts a flexible fluid conduit having a combination of rigid pipe segments and flexible pipe segments in accordance with one embodiment.

One example of a fluid conduit 48 for routing fluid between the fracturing manifold 22 and a fracturing tree 20 is depicted in FIG. 4. In this embodiment, the fluid conduit 48 includes a combination of rigid pipe segments 52 and flexible pipe segments 54. These pipe segments 52 and 54 can be formed of any suitable materials. In at least some instances, the rigid pipe segments 52 are steel pipes and the flexible pipe segments 54 are polymeric pipes, such as pipes including polyetheretherketone (PEEK) or another polymer in the polyaryletherketone (PAEK) family. The flexible pipe segments 54 may also or instead be provided as flexible composite pipes.

The inclusion of polymeric or composite materials in the flexible pipe segments 54 may reduce the weight of the conduit 48, as compared to a conduit formed entirely of steel. Further, the flexibility provided by such materials allows the conduit 48 to be bent at one or more of the flexible pipe segments 54 to allow an operator to more easily install the conduit 48 between the fracturing manifold 22 and a fracturing tree 20. For example, a flexible pipe segment 54 can be connected between two rigid pipe segments 52, such as shown in FIG. 4. In this arrangement, the flexible pipe segment 54 serves as a flexible joint, allowing the two rigid pipe segments 52 joined to the flexible pipe segment 54 to be positioned in different directions by bending the conduit 48 at the flexible joint. This, in turn, allows the distance between the ends of the conduit 48 to be varied during installation and facilitates connection of a conduit 48 of a given length between the fracturing manifold 22 and a fracturing tree 20. More particularly, this bending capability allows the profile of the conduit 48 to be changed to accommodate differences in spacing, elevation, and angular alignment between the manifold 22 and fracturing trees 20 in different installations. When connecting the fracturing manifold 22 to a fracturing tree 20 with a fluid conduit 48, the components of the fluid conduit 48 can be connected together and to the manifold 22 and the tree 20 in any suitable order.

In some cases, the bend radius of a flexible pipe segment 54 may be too high to provide a desired amount of bend in the conduit 48 along the length of the pipe segment 54. In such instances, multiple flexible pipe segments 54 can be connected to one another in series to allow additional bending of the conduit 48 along a given portion. One example of this is shown in FIG. 4, with a series 58 of flexible pipe segments 54 connected together between two rigid pipe segments 52.

Fracturing fluid typically contains sand or other abrasive particulates that can erode conduits through which the fracturing fluid flows. The rate of such erosion depends on many factors, but is generally greater at locations in which the direction of flow is changed, such as at elbows or bends in a conduit. As depicted in FIG. 4 and described above, the conduit 48 includes flexible pipe segments 54. While such flexible pipe segments 54 allow bending of the conduit 48 to facilitate its installation, this bending can make the flexible pipe segments 54 more susceptible to erosive wear in fracturing applications. In at least some embodiments, one or more of the flexible pipe segments 54 includes an interior liner (which may also be referred to as a wear sleeve) to reduce erosive effects from flow of fracturing fluid or other abrasive fluids through the conduit 48.

Figure 5:
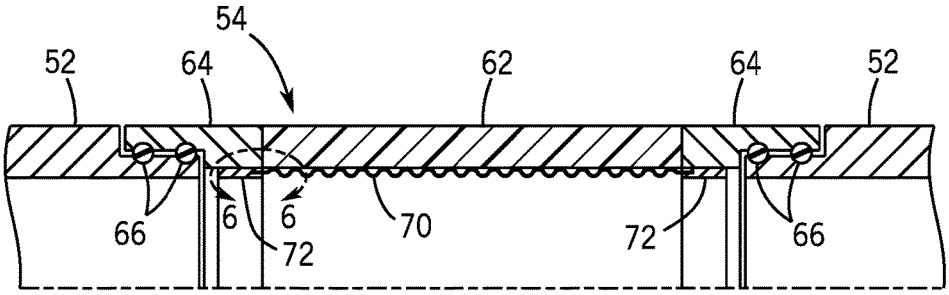
FIG. 5 is a partial cross-section of the fluid conduit of FIG. 4 and shows a flexible pipe segment having an outer pipe body and a corrugated liner in accordance with one embodiment.

A partial cross-section of the conduit 48 is depicted in FIG. 5 as having two rigid pipe segments 52 joined by a flexible pipe segment 54 having a liner. In this example, the flexible pipe segment 54 includes an outer pipe body 62 with connectors 64 at its ends. The outer pipe body 62 is a flexible body, and in at least some embodiments is provided as a polymeric body or a composite body (which may also include a polymer). The connectors 64, which are rigid steel connectors in certain embodiments, can be attached to the outer pipe body 62 in any suitable manner and facilitate connection of the outer pipe body 62 to the rigid pipe segments 52. Further, although particular connectors 64 are shown in FIG. 5 by way of example, any other connectors suitable for joining the outer pipe body 62 to the pipe segments 52 may instead be used. The coupling of the outer pipe body 62 to the pipe segments 52 should be fluid-tight to avoid leakage from the conduit 48 during use. This may be accomplished with discrete seals (e.g., seals 66 in FIG. 5) or in any other desired fashion.

The flexible pipe segment 54 also includes a liner 70 positioned within the outer pipe body 62. Various forms of an interior liner can be used to reduce erosion of the outer pipe body 62, but in FIG. 5 the liner 70 is depicted as a corrugated liner. In at least some embodiments, the corrugated liner is made of steel or some other metal. The liner 70 can have annular corrugations or be spiral-wound (with a helical corrugation pattern). In either case, the corrugations generally increase the flexibility of the liner 70 and reduce its bending radius as compared to a smooth liner made with the same material. The liner 70 and the outer pipe body 62 can bend to facilitate coupling of the conduit 48 between the fracturing manifold 22 and a fracturing tree 20, as described above.

Figure 6:
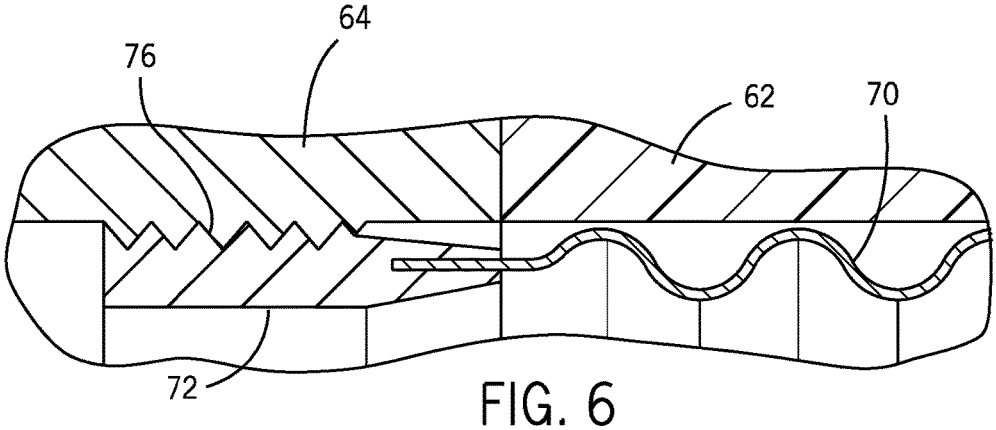
FIG. 6 is a detail view of a retaining ring for holding the corrugated liner of FIG. 5 within the outer pipe body in accordance with one embodiment.

During fluid flow through the conduit 48, the liner 70 reduces impingement of abrasive particulates on the inner surface of the outer pipe body 62 and, consequently, reduces erosive wear of the outer pipe body 62. The liner 70, however, may itself erode in the presence of abrasive flow. Accordingly, in some embodiments the liner 70 is a removable liner. For example, as depicted in FIG. 5, the liner 70 is retained within the outer pipe body 62 by retaining rings 72. These retaining rings 72 can be attached to the flexible pipe segment 54 in any desired manner, but are shown here as having threads 76 to allow the retaining rings 72 to be threaded to a mating, interior surface of the connectors 64. As generally illustrated in FIG. 6, the retaining rings 72 include tapered noses that receive ends of the liner 70 and hold the liner 70 within the outer pipe body 62. In some cases, the retaining rings 72 seal against the corrugated liner 70. Additionally, the routing of high-pressure fluid through the conduit 48 can create a differential between the interior and exterior pressures of the liner 70 and a radially outward force that causes the liner 70 to flatten against the inner surface of the outer pipe body 62.

Figure 7:
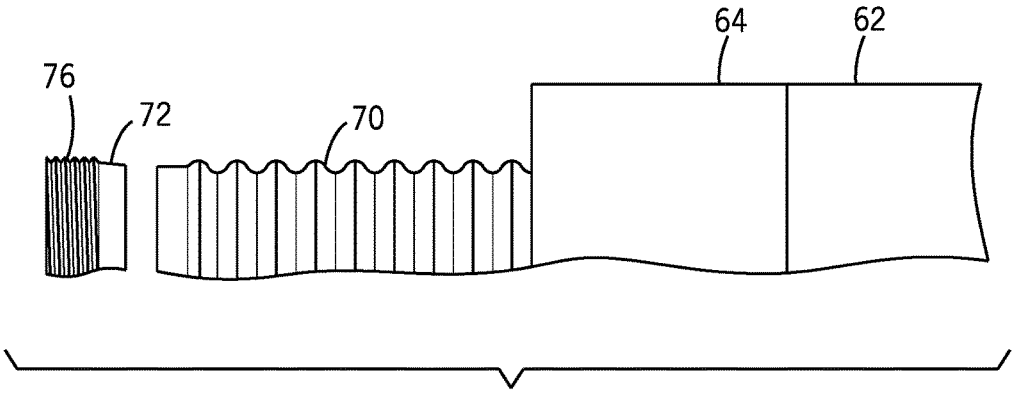
FIG. 7 is a partial exploded view of components of a flexible pipe segment and generally depicts removal of the retaining ring and corrugated liner of FIG. 6 from the outer pipe body.

After the conduit 48 is used to convey fracturing fluid, the conduit 48 can be disconnected from the fracturing manifold 22 and a fracturing tree 20. A flexible pipe segment 54 having the liner 70 can be disconnected from an adjoining rigid or flexible pipe segment, and the retaining ring 72 can be removed from the flexible pipe segment 54 (e.g., from the connector 64) to allow the liner 70 to be pulled from the outer pipe body 62, as generally shown in FIG. 7. A replacement liner 70 can then be installed in the outer pipe body 62 in place of the removed liner, allowing the non-liner portions of the flexible pipe segment 54 to be re-used in additional fracturing operations. That is, once the liner 70 is replaced, the flexible pipe segment 54 can again be connected as part of a conduit 48 coupled between a fracturing tree 20 and a fracturing manifold 22 (which may be the same fracturing manifold as previously used or a different fracturing manifold) for routing fracturing fluid between the tree and the manifold. The liner 70 can be replaced at any desired interval, such as after each use or after some other set number of uses, or can be replaced on an as-needed basis.

Figure 8:
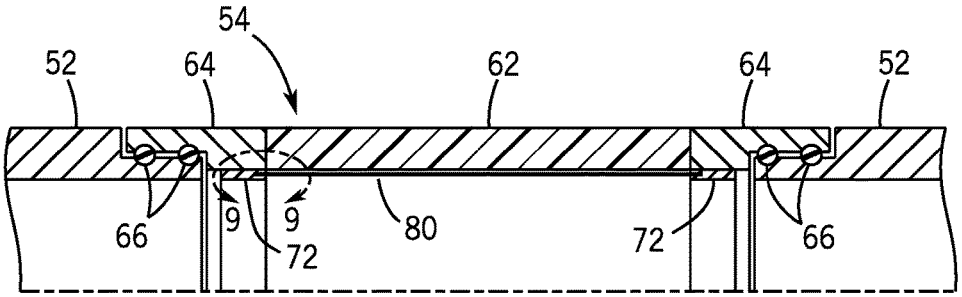
FIG. 8 is a partial cross-section of a flexible pipe segment similar to that of FIG. 5, but having a mesh liner instead of a corrugated liner, in accordance with one embodiment.
Figure 9:
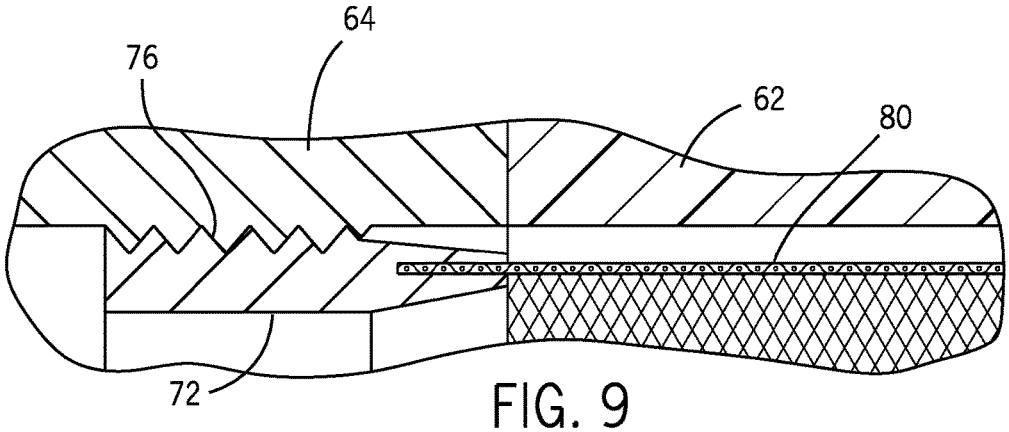
FIG. 9 is a detail view of a retaining ring and a portion of the mesh liner of FIG. 8 within the outer pipe body in accordance with one embodiment.

In another embodiment depicted in FIGS. 8 and 9, a flexible pipe segment 54 of the fluid conduit 48 includes a wire-mesh liner 80 (e.g., a steel wire-mesh liner) instead of the corrugated liner 70. The mesh liner 80 can be held in place within the outer pipe body 62 with retaining rings 72 (or in some other suitable manner) and reduces erosive wear of the outer pipe body 62 from fracturing fluid (or some other abrasive fluid) flowing through the conduit 48. The mesh liner 80 can be installed and replaced in a manner similar to that of the corrugated liner 70.

Figure 10:
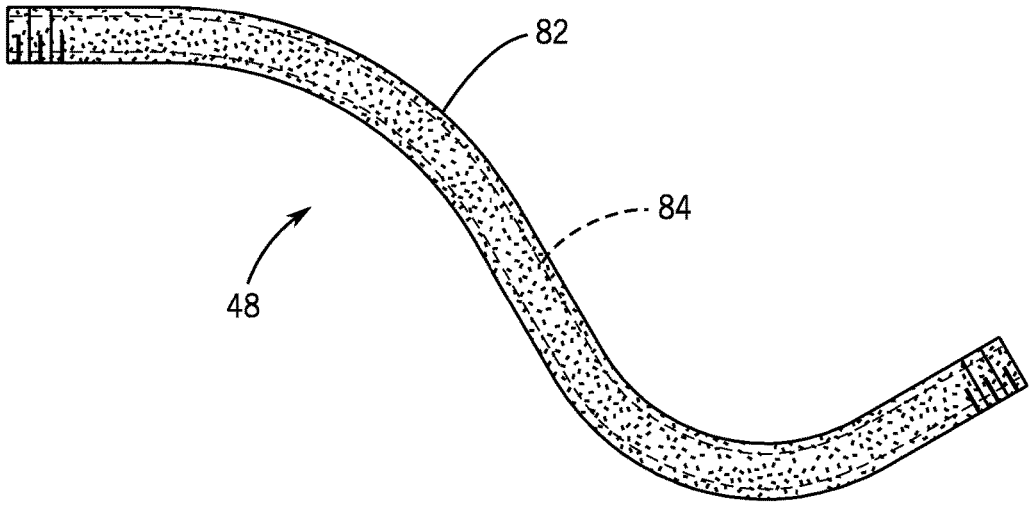
FIG. 10 depicts a flexible fluid conduit having a continuous, flexible pipe body, rather than a combination of rigid and flexible pipe segments, in accordance with one embodiment.

As described above, the fluid conduit 48 can include a combination of rigid pipe segments and flexible pipe segments coupled together to route fracturing fluid between the fracturing manifold 22 and a fracturing tree 20. But in some additional embodiments, rather than having flexible pipe segments that serve as flexible joints between rigid pipe segments and bend to facilitate installation, the conduit 48 is instead provided as a continuous flexible pipe that can be used to route fluid between the fracturing manifold 22 and a fracturing tree 20. One example of such a conduit 48 is generally depicted in FIG. 10 as having an outer pipe body 82 and a suitable liner 84, such as a corrugated liner, a mesh liner, or a smooth liner as described above. In some instances, the liner 84 is a removable liner that is retained within the outer pipe body 82 and can be replaced as desired. The outer pipe body 82 is depicted in FIG. 10 as having threaded ends, such as to facilitate coupling to connection flanges or directly to the manifold 22 and a tree 20, but the outer pipe body 82 can be connected between the manifold 22 and the tree 20 in any other suitable manner.

The conduits 48 and the fracturing fluid delivery systems described above can be constructed for various operating pressures and with different bore sizes depending on the intended application. In some embodiments, the fluid conduits 48 are constructed for rated maximum operating pressures of 10-15 ksi (approximately 69-103 MPa). Further, the conduits 48 of some embodiments have bores between four and eight inches (approx. 10 and 20 cm) in diameter, such as a five-and-one-eighth-inch (approx. 13 cm) diameter or a seven-inch (approx. 18 cm) diameter.

Still further, the conduits 48 described above could also be used to convey fluid between other components. For example, one system could include an intermediate fracturing manifold that receives fracturing fluid from the fracturing manifold 22 and distributes the fracturing fluid to multiple fracturing trees 20. Fluid conduits 48 could be used to connect the two fracturing manifolds together or could be used to connect the intermediate fracturing manifold to the fracturing trees 20.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method comprising:

coupling a fluid conduit having an outer body and a liner inside the outer body to one of a fracturing manifold or a fracturing tree;

bending the outer body and the liner at a flexible portion of the fluid conduit to facilitate alignment of the fluid conduit between the fracturing manifold and the fracturing tree;

coupling the fluid conduit to the other of the fracturing manifold or the fracturing tree, wherein the fluid conduit completes a fluid connection between the fracturing manifold and the fracturing tree so that fracturing fluid can be routed between the fracturing manifold and the fracturing tree through the fluid conduit;

disconnecting the fluid conduit from the fracturing tree and from the fracturing manifold;

removing the liner from the outer body of the fluid conduit;

installing a replacement liner in the outer body in place of the removed liner; and coupling the fluid conduit with the replacement liner between an additional fracturing tree and either the fracturing manifold or an additional fracturing manifold so as to place the additional fracturing tree in fluid communication with either the fracturing manifold or the additional fracturing manifold via the fluid conduit with the replacement liner.

2. The method of claim 1, comprising routing fracturing fluid between the fracturing manifold and the fracturing tree through the fluid conduit.

3. The method of claim 1, wherein removing the liner from the outer body of the fluid conduit includes removing a retaining ring holding the liner within the outer body and then pulling the liner out of the outer body.

4. The method of claim 1, wherein the fluid conduit includes both the flexible portion and a rigid portion, and removing the liner from the outer body of the fluid conduit includes disconnecting the flexible portion from the rigid portion and then pulling the liner out of the flexible portion.

5. The method of claim 1, wherein at least a portion of the fluid conduit is rigid and bending the outer body and the liner at the flexible portion of the fluid conduit includes bending the outer body and the liner at a flexible joint of the fluid conduit.

6. The method of claim 2, wherein routing fracturing fluid between the fracturing manifold and the fracturing tree through the fluid conduit includes operating a valve to control flow of the fracturing fluid from the fracturing manifold to the fracturing tree through the fluid conduit.

7. The method of claim 6, wherein operating the valve to control flow of the fracturing fluid from the fracturing manifold to the fracturing tree through the fluid conduit includes operating a valve mounted on a skid of the fracturing manifold to control flow of the fracturing fluid from the fracturing manifold to the fracturing tree.

8. The method of claim 1, wherein coupling the fluid conduit having the outer body and the liner inside the outer body to one of the fracturing manifold or the fracturing tree includes coupling a fluid conduit including at least one of a polymer or composite material to the one of the fracturing manifold or the fracturing tree.

9. The method of claim 1, wherein removing the liner from the outer body of the fluid conduit includes removing a corrugated liner from the outer body of the fluid conduit.

10. The method of claim 1, wherein removing the liner from the outer body of the fluid conduit includes removing a mesh liner from the outer body of the fluid conduit.

11. A method comprising:

coupling a fluid conduit having an outer body and a liner inside the outer body to one of a fracturing manifold or a fracturing tree;

bending the outer body and the liner at a flexible portion of the fluid conduit to facilitate alignment of the fluid conduit between the fracturing manifold and the fracturing tree;

coupling the fluid conduit to the other of the fracturing manifold or the fracturing tree, wherein the fluid conduit has a bore diameter of between four inches and eight inches and completes a fluid connection between the fracturing manifold and the fracturing tree so that fracturing fluid can be routed between the fracturing manifold and the fracturing tree through the fluid conduit;

disconnecting the fluid conduit from the fracturing tree and from the fracturing manifold;

removing the liner from the outer body of the fluid conduit;

installing a replacement liner in the outer body in place of the removed liner; and coupling the fluid conduit with the replacement liner between an additional fracturing tree and either the fracturing manifold or an additional fracturing manifold so as to place the additional fracturing tree in fluid communication with either the fracturing manifold or the additional fracturing manifold via the fluid conduit with the replacement liner.

12. The method of claim 11, wherein the fluid conduit has a bore diameter of seven inches.

13. A method comprising:

coupling a fluid conduit having an outer body and a liner inside the outer body to one of a fracturing manifold or a fracturing tree;

bending the outer body and the liner at a flexible portion of the fluid conduit to facilitate alignment of the fluid conduit between the fracturing manifold and the fracturing tree;

coupling the fluid conduit to the other of the fracturing manifold or the fracturing tree, wherein the fluid conduit has a bore diameter of between four inches and eight inches, is rated for a maximum operating pressure between 10 ksi and 15 ksi, and completes a fluid connection between the fracturing manifold and the fracturing tree so that fracturing fluid can be routed between the fracturing manifold and the fracturing tree through the fluid conduit;

disconnecting the fluid conduit from the fracturing tree and from the fracturing manifold;

removing the liner from the outer body of the fluid conduit;

installing a replacement liner in the outer body in place of the removed liner; and coupling the fluid conduit with the replacement liner between an additional fracturing tree and either the fracturing manifold or an additional fracturing manifold so as to place the additional fracturing tree in fluid communication with either the fracturing manifold or the additional fracturing manifold via the fluid conduit with the replacement liner.

* * * * *